United States Patent [19]

Donath et al.

[11] Patent Number: 4,637,174

[45] Date of Patent: Jan. 20, 1987

[54] DEVICE AND METHOD FOR THE SURFACE TREATMENT OF COLD-EMBRITTLED PARTS

[75] Inventors: Sabine Donath, Oberhausen; Peter Holz, Linnich, both of Fed. Rep. of Germany

[73] Assignee: Messer Griesheim GmbH, Frankfurt, Fed. Rep. of Germany

[21] Appl. No.: 764,863

[22] Filed: Aug. 12, 1985

[30] Foreign Application Priority Data

Aug. 18, 1984 [DE] Fed. Rep. of Germany ..... 3430529

[51] Int. Cl.[4] ..... B24C 9/00

[52] U.S. Cl. ..... 51/425; 51/322; 51/434; 51/436; 241/DIG. 37

[58] Field of Search ..... 51/322, 425, 424, 426, 51/319, 412, 436, 432, 434; 241/DIG. 37

[56] References Cited

U.S. PATENT DOCUMENTS

| | | | |
|---|---|---|---|
| 3,008,274 | 11/1961 | Welter | 51/424 |
| 3,857,201 | 12/1974 | Jacob | 51/319 |
| 4,164,103 | 8/1979 | Hesse et al. | 51/425 |
| 4,519,812 | 5/1985 | Brull et al. | 51/322 |

*Primary Examiner*—Robert P. Olszewski
*Assistant Examiner*—Bradley I. Vaught
*Attorney, Agent, or Firm*—Connolly and Hutz

[57] ABSTRACT

Cold-embrittled parts are surface treated by an abrasive jet through the use of an arrangement which includes as a centrifuge wheel. The centrifuge wheel is self-priming and is connected to a granulate collecting tank via a suction pipe with a spray nozzle for low boiling liquefied gas being arranged in the inlet zone of the suction pipe. The resulting abrasive jet pattern is of the same shape and size as the treatment surface.

4 Claims, 3 Drawing Figures

DEVICE AND METHOD FOR THE SURFACE TREATMENT OF COLD-EMBRITTLED PARTS

BACKGROUND OF THE INVENTION

The present invention pertains to the surface treatment of cold-embrittled parts. Surface treatment is used to refer to deburring, lacquer removal, separation and stripping, as well as hardening and polishing.

A great number of devices are known for the surface treatment of cold-embrittled parts. A conveyer means by which the parts are conveyed and rotated, as well as a spray means for a low boiling, liquefied gas, usually nitrogen, and at least one centrifuge wheel for a jet material, e.g., cast steel or plastic granules, are common features of all these devices. The known conveying means include especially rotary drums, belts circulating in a drum-like manner, or rotary plates. A device for deburring parts is known from West German Offenlegungsschrift No. 26 50 202, in which the parts are moved on a cradle which is equipped with screens for separating granulate, coarse chips and dust. The device is equipped with at least one centrifuge wheel throwing off granulate in horizontal direction. The centrifuge wheel is surrounded by a conical deflecting collar ring with a cone angle of 90°. The granulate thrown off horizontally is reflected by this deflecting collar ring downward to the work surface of the cradle. The nozzles for the low boiling liquefied gas are disposed at the edge of the deflecting collar ring. The surface treatments of cold-embrittled parts which are to be carried out normally can be performed with this prior art device in a satisfactory manner. The only exception is small and delicate parts which must be treated rapidly and gently and which are normally produced in small batches only. Even though the prior art device guarantees that the kinetic energy of the granulate striking the work surface is equal in all points, it is inevitable that the parts are subject to the jet treatment for different lengths of time depending on their position on the work surface, this is irrelevant in most surface treatment operations as long as the desired effect, e.g., complete deburring, is achieved. However, delicate, small parts are sensitive to differences in the jet treatment time. It has also been found that such parts can become damaged due to another effect in certain cases.

The granulate used for the jet treatment is always recirculated, which requires the separation of dust and coarse chips. However, the chips whose size corresponds to the size of the grains of the granulate are not separated in this process. Together with the original granulate, these chips are involved in the jet treatment and become gradually shattered completely only after several cycles. This is usually completely irrelevant for the surface treatment. However, if these chips are harder or have a higher density than the granulate, they can damage delicate, small parts or parts with sensitive surfaces.

SUMMARY OF INVENTION

The present invention has as its object creating a device for the surface treatment of cold-embrittled parts which make it possible — based on the prior art device — to treat even sensitive and small, delicate parts, preferably in small batches, rapidly and in a gentle manner.

The device and method according to the present invention is based on the concept of making the shape and size of the work surface identical with the pattern of the jet. It is achieved hereby that not only are the parts struck by granulate particles with equal kinetic energy, but the total number of the granulate particles striking the parts is also nearly identical for each part while traversing the cradle. It is achieved by the measure according to the present invention, i.e., the provision of an auxiliary spray nozzle for low boiling liquefied gas in the inlet zone of the suction pipe of the self-priming centrifuge wheel that the granulate which is captured by the centrifuge wheel is already deep-frozen. The chips being recirculated with the granulate are thereby embrittled and are shattered on impact on the deflecting collar rings, so that they are no longer able to damage the sensitive parts. Further advantages of the present invention will become apparent from the following description of an embodiment. It is a surface treatment device according to the present invention, which can be manufactured in different sizes, but is manufactured preferably as a small device for treating small batches.

THE DRAWINGS

DETAILED DESCRIPTION

Figure 1:
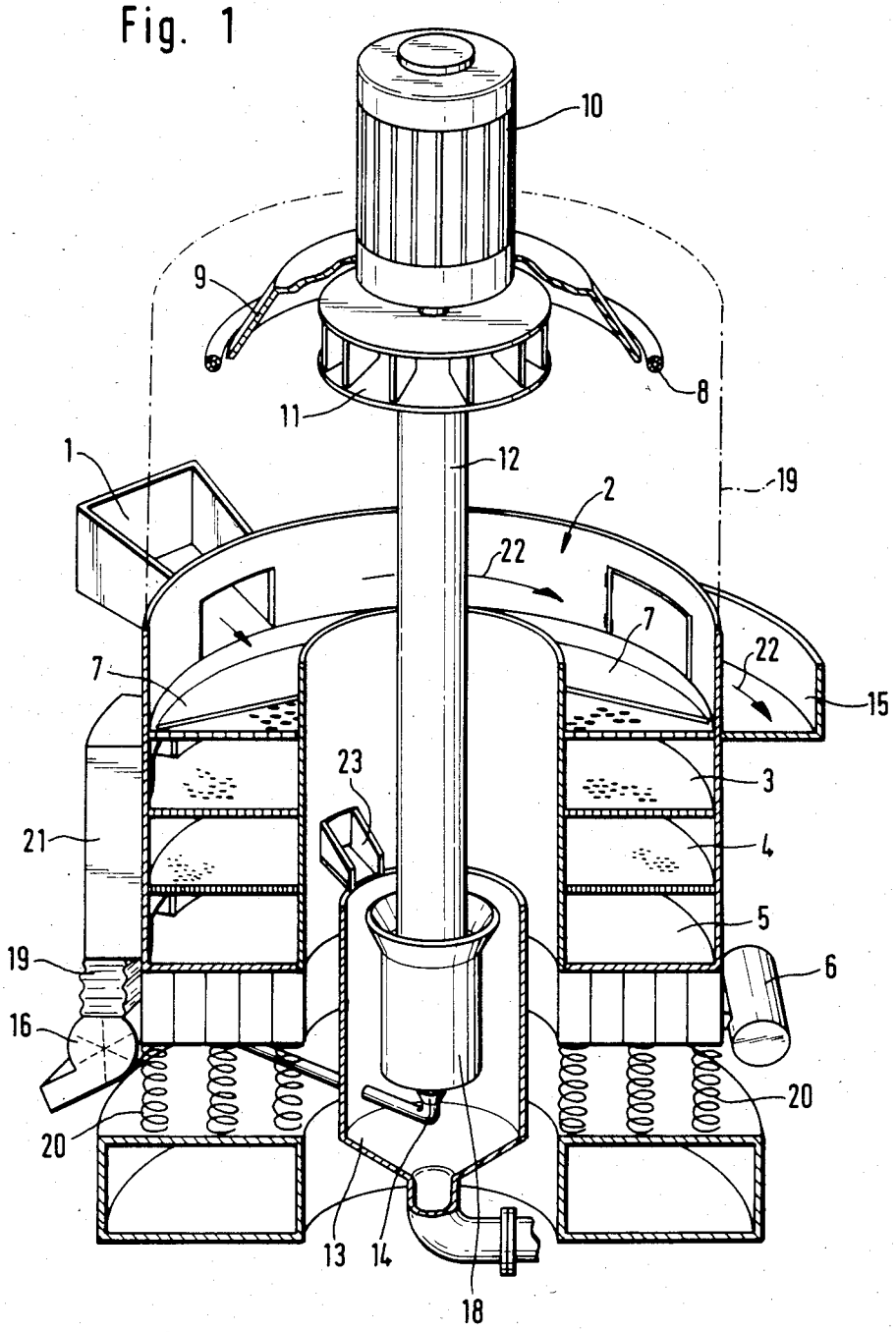
FIG. 1 shows a partially sectional perspective view of the jet type surface treatment device and of the cradle of a device according to the present invention.
Figure 2:
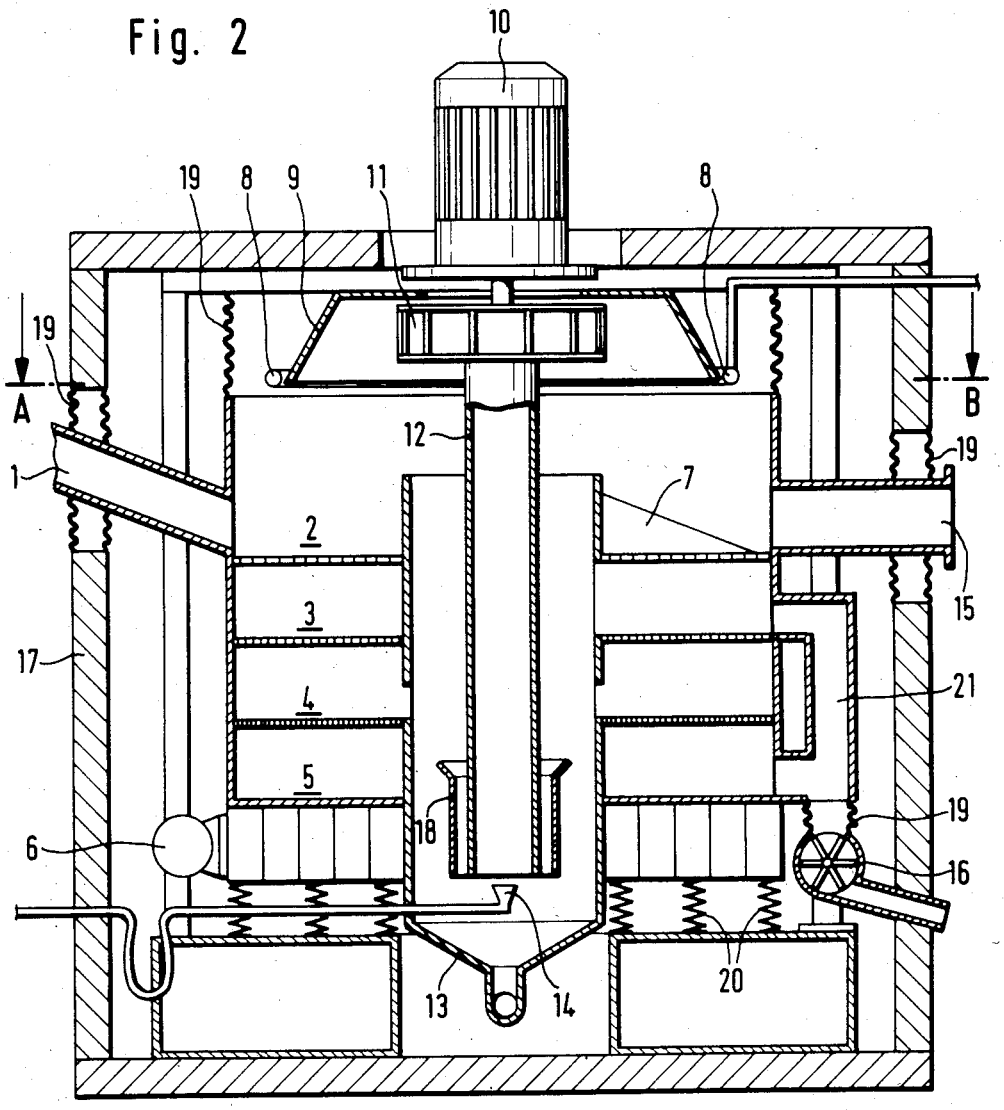
FIG. 2 shows the longitudinal section of a device which is a slightly modified form of that of FIG. 1.

FIG. 1 shows the internal part of a device according to the present invention for the surface treatment of cold-embrittled parts, comprising the jet treatment device and the cradle. This internal part is housed in an insulating cell (not shown). The parts to be treated are charged into the ring-shaped treatment through 2 which is part of the cradle via a chute 1. The ring-shaped treatment trough 2 is the work surface which is struck uniformly be the granulate jet. Coarse waste, granulate and dust fall through screen openings in the treatment trough 2 into the screen trough 3 for coarse waste. The coarse waste is separated here and it is removed to the outside through a chute 21, the bellows 19 and the dust and waste sluice 16. The granulate and dust enter the screen trough 4 for granulate, where the dust is screened off. This dust falls into the dust trough 5 and is also removed to the outside through the chute 21, the bellows 19 and the dust and waste sluice 16. The treatment trough 2, the screen trough 3 for coarse waste, the screen trough 4 for granulate and the dust trough 5 together form the cradle. There is vibrated by two unbalanced motors. Due to this vibration, the parts are moved in the direction of the arrows 22 and turned and circulated by means of the inserts 7, and the granulate is also separated from the waste and dust. The granulate separated falls from the screen trough 4 via a chute 23 into the granulate collecting tank 13. The chute 23 is eliminated in the embodiment according to FIG. 2, because the granulate can drop immediately into the collecting tank 13.

Figure 3:
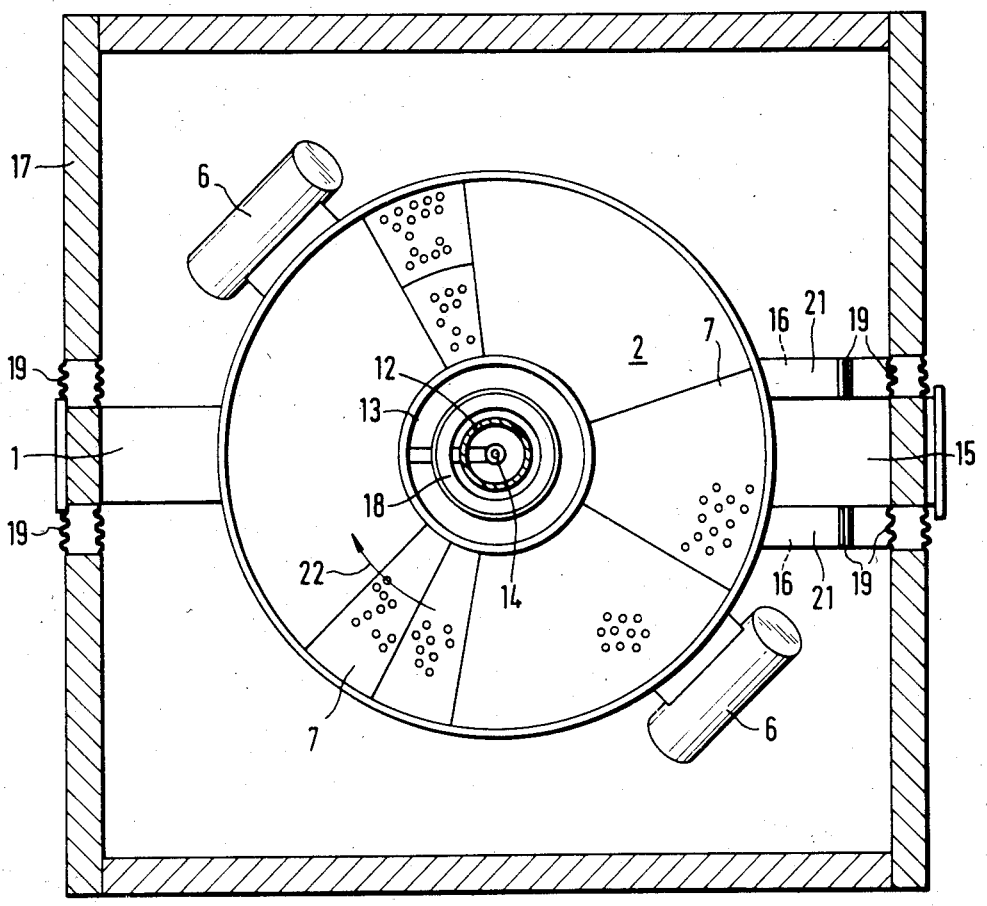
FIG. 3 is a cross-sectional view along the line A–B in FIG. 2.

The jet treatment comprises the self-priming centifuge wheel 11 which is driven by the motor 10. The centrifuge wheel sucks in the granulate through the suction pipe 12 and throws it off in horizontal direction toward the deflecting collar ring 9. The deflecting collar ring 9 reflects the granulate toward the treatment trough 2. Spray nozzles 8 for spraying liquid nitrogen are disposed at the end of the deflecting collar ring 9. The finished parts are removed to the outside through the discharge opening 15. The embodiment according to FIGS. 2 and 3 differs from that in FIG. 1 basically only by the small internal diameter of the cradle. The same reference numerals are therefore used for corresponding parts, and the insulating cell 17 is also shown additionally.

A spray nozzle 14 for liquid nitrogen is arranged according to the present invention in the intake zone of the suction pipe 12. The granulate sucked in is cooled intensely by liquid nitrogen. This cooling causes material particles, such as burrs or rests of coatings, which have the same size as the granulate, and which cannot consequently be separated from the granulate stream by screening, to become brittle and to be shattered on impact on the deflecting collar ring 9. Therefore, it cannot happen that the parts are damaged by the materials whose density is higher than that of the granulate due to the higher kinetic energy of these impacted material particles. In addition, the device also permits the rest of the material thus shattered to be separated by screening, whereby the purity of the circulating granulate is increased.

An especially advantageous embodiment is obtained when the spray nozzle 14 is disposed underneath the intake opening of the suction pipe, in its axis in the direction of the stream. This arrangement intensifies the granulate stream into the suction pipe 12, whereby the amount of granulate being circulated is increased. The inlet nozzle 18 arranged at the intake end of the suction pipe 12 brings about a further increase in the amount of the granulate stream. This nozzle is funnel-shaped and surrounds the suction pipe 12, forming a ring-shaped space. The inlet nozzle 18 captures part of the granulate flowing back from the screen trough 4 into the collecting tank 13, and delivers it into the suction pipe 12. In addition to an increase in the granulate stream, this leads to an especially collant utilization, because cooled granulate preferably enters the suction trough 12 from the screen trough 4, and a reduced amount of the warmer granulate is sucked in from the collecting tank 13. The entire cradle is mounted in springs 20. Bellows 19 are installed at all transitions between vibrating and fixed members, so that there can be no contact points in which the parts could become damaged.

The surface treatment can be individually adapted to a great variety of parts by changing the amplitude and the frequency of the vibrations as well as the shape of the inserts 7 (tilting or rolling tongues). The connections to the outside through the insulated cell 17 are reduced to a minimum, and the insulation effect is therefore high and the coolant consumption is low. This makes it possible to design the device according to the present invention as a small device for very small part batches as well. The jet energy density of the work surface can be varied within very broad limits by varying the speed of rotation of the centrifuge wheel as well as the type and size of the granulate, so that many different materials, shapes and burr thicknesses can be handled. The treatment time can also be varied within broad limits.

Since there are no realtive movements between the treatment part and the screen unit, jet granulate cannot be scattered, and dust and cold gas cannot leave the device in a useless manner, which increases the readiness for service.

Since the circulation is brought about by vibration and tilting or rolling on fixed members, the parts cannot become jammed, which can happen in troughed belt conveyers and drums, where especially small and delicate parts can be crushed between moving and stationary members.

SUMMARY

A known device for the surface treatment of cold-embrittled parts by jet treatment with granulate consists of one or more centrifuge wheels throwing off material in horizontal direction. The centrifuge wheels are surrounded by deflecting collar rings 9 which deflect the granulate jet toward the treatment surface. Spray nozzle 8 for a low boiling liquefied gas are provided on the deflecting collar rings. The treatment surface is part of a cradle which rotates the parts and moves them through the device. This device is not particularly suitable for sensitive parts and for parts produced in small batches, because the parts are exposed to the jet at different intensities, depending on their location on the treatment surface. In addition, they can also be damaged by course chips the size of the granules.

In order to treat even sensitive parts in a satisfactory manner, a treatment is designed in such a way that the treatment surface has the same shape and size as the abrasive jet pattern. In addition, the centrifuge wheel is designed as a self-priming wheel, and the granulate sucked in is deep-frozen by low boiling liquefied gas. The waste present in the granulate thus becomes brittle and is shattered on impact on the deflecting collar ring, so that it is no longer able to damage the surface of the parts.

What is claimed is:

1. In a device for the surface treatment of cold-embrittled parts by jet treatment with granulate drawn from a collecting tank and recirculated, and by spraying with a low boiling liquefied gas, comprising a centrifuge wheel throwing off granulate in horizontal direction, a deflecting collar ring arranged around the centrifuge wheel for reflecting the granulate towards the work surface, spray nozzles for the low boiling liquefied gas and a treatment surface which is part of a cradle, with screens for separating granulate, coarse waste and dust, the improvement being means whereby the treatment surface is of circular shape and has the same shape and size as the abrasive jet pattern, said centrifuge wheel being self-priming, said granulate collecting tank being connected to said centrifuge wheel via a suction pipe, said spray nozzle for said low boiling liquefied gas being arranged in the inlet zone of said suction pipe, said treatment surface and said abrasive jet pattern being ring shaped, and said suction pipe extending concentrically through said treatment surface.

2. Device in accordance with claim 1, characterized in that said spray nozzle is located underneath the intake opening of said suction pipe and coaxially with said suction pipe.

3. Device in accordance with claim 2, characterized in that the intake end of said suction pipe is surrounded by a funnel-shaped inlet nozzle for the granulate being recirculated whereby a ring-shaped space is formed.

4. Device in accordance with claim 1, characterized in that the intake end of said suction pipe is surrounded by a funnel-shaped inlet nozzle for the granulate being recirculated whereby a ring-shaped space is formed.

* * * * *